US005868202A

United States Patent [19]

Hsu

[11] Patent Number: 5,868,202

[45] Date of Patent: Feb. 9, 1999

[54] HYDROLOGIC CELLS FOR RECOVERY OF HYDROCARBONS OR THERMAL ENERGY FROM COAL, OIL-SHALE, TAR-SANDS AND OIL-BEARING FORMATIONS

[75] Inventor: Kenneth J. Hsu, Zurich, Switzerland

[73] Assignee: Tarim Associates for Scientific Mineral and Oil Exploration AG, Zurich, Switzerland

[21] Appl. No.: 936,150

[22] Filed: Sep. 22, 1997

[51] Int. Cl.[6] ..... E21B 43/24

[52] U.S. Cl. ..... 166/256; 166/260; 166/261; 405/265

[58] Field of Search ..... 166/256, 260, 166/261, 300, 302, 303, 305.1, 306, 63; 405/130, 131, 265

[56] References Cited

U.S. PATENT DOCUMENTS

| | | | |
|---|---|---|---|
| 3,456,731 | 7/1969 | Parker | 166/256 |
| 3,775,073 | 11/1973 | Rhoades | 166/257 X |
| 3,997,005 | 12/1976 | Komar | 166/251 X |
| 4,050,515 | 9/1977 | Hamrick et al. | 166/53 X |
| 4,069,867 | 1/1978 | Bissett | 166/256 |
| 4,160,479 | 7/1979 | Richardson et al. | 166/267 |
| 4,384,613 | 5/1983 | Owen et al. | 166/256 |
| 4,450,910 | 5/1984 | Hunt | 166/261 |
| 4,625,800 | 12/1986 | Venkatesan | 166/256 |
| 4,818,370 | 4/1989 | Gregoli et al. | 166/256 X |
| 5,287,926 | 2/1994 | Grupping | 166/256 |

*Primary Examiner*—Roger Schoeppel
*Attorney, Agent, or Firm*—Helfgott & Karas, P.C.

[57] ABSTRACT

A system for recovery of hydrocarbons or thermal energy from host-rock formations bearing coal, oil-shale, tar-sands or oil by use of a hydrologic cell which conveys a reacting fluid under pressure to a source-aquifer, thereafter extracting thermal energy or hydrocarbons from said host-rock, moving said hydrocarbons or thermal energy to said sink-aquifer and then removing the hydrocarbons or thermal energy to the surface for ultimate use.

7 Claims, 4 Drawing Sheets

HYDROLOGIC CELLS FOR RECOVERY OF HYDROCARBONS OR THERMAL ENERGY FROM COAL, OIL-SHALE, TAR-SANDS AND OIL-BEARING FORMATIONS

BACKGROUND OF THE INVENTION

This invention relates to the recovery of hydrocarbons and to the recovery of energy from carbon or hydrocarbon-bearing rocks.

Coal and lignite are normally mined by excavation and oil is produced by drilling oil-bearing rocks. With the depletion of worldwide reserves of liquid-fuel hydrocarbon, there has been much effort to extract hydrocarbon from oil-shales, coals, tar-sands and other carbon and hydrocarbon-bearing rocks. Those rocks can be excavated and subsequently retorted, distilled, or hydrogenated. Processes are known for chemical processing of oil-shales, coals, tar-sands, etc., in factories. The intensive costs of mining and processing make such processes uneconomical as long as liquid-fuel can be obtained cheaply. Furthermore, the environmental problems caused by the mining of large volumes of oil-shale and tar-sands make mining unacceptable.

Current in-situ methods have the advantage of protecting the environment. Technology for in-situ recovery of hydrocarbons from oil-shale, tar-sands, and coal, and for secondary recovery of hydrocarbons from oil-bearing beds have been developed during the last several decades. Hundreds of patents have been issued using processes such as:

(1) Processes to enhance the porosity and permeability of hydrocarbon and carbon-bearing formations so that hydrocarbons could flow or be pumped out from underground. The methods include (a) hydrofracturing, (b) blasting, and (c) undercutting over a large area to cause the collapse of the overlaying deposit into the excavation, or a combination of those;

(2) Processes to inject fluid into injection wells, and thus to provide a hydrodynamic potential to force the injected fluid to displace the hydrocarbons in oil-bearing beds so that the latter can flow into production-wells and then be removed. A most common method of this type of process is secondary recovery by water-flooding;

(3) Processes to provide a heat source such as steam-flooding, or by other means to increase the underground temperature and thus to lower the viscosity of hydrocarbons in oil-bearing beds, tar-sand, or coal sufficiently to flow or be pumped out from underground. The methods are commonly called thermal-stimulations; and (4) Processes to inject fluid into injection wells, to provide a hydrodynamic potential to force the injected fluid into contact with the carbon or hydrocarbon-bearing rock, producing hydrocarbons which can flow into production wells and be removed.

Current in-situ methods use one or a combination of these processes. Methods for recovering carbonaceous materials from oil-shales, collectively known as "shale-burning" are described in U.S. Pat. Nos. 3,661,423, 4,106,814, 4,109,719, 4,147,389, 4,151,877, 4,158,467 and DE 4,153,110. These are methods of in-situ retorting using a combination of processes (1) and (2). None of the methods are economical at the present, and are not in commercial use.

Other in-situ methods such as steam-flooding, thermal-stimulation, gasification of coal, hydrogenation of tar-sand, in-situ combustion, etc. represent other combinations of those processes (e.g., U.S. Pat. Nos. 4,085,803, 4,089,373, 4,089,374, 4,093,027, 4,088,188, 4,099,568, 4,099,783, 4,114,688, 4,133,384, 4,148,359, 4,149,595, 4,476,932, 4,574,884, 4,598,770, 4,896,345, 5,207,271, 5,360,068 and Int. Publ. No. WO 95/06093). All of those methods require the injection of fluid or insertion of a heat source, via injection wells, directly into the carbon or hydrocarbon-bearing formations and they prescribe the production of hydrocarbons (or hot gases) from production wells. Commonly the wells are vertically drilled into a hydrocarbon-bearing formation, and fluid or heat flows horizontally from well to well. The movement from a point source in the injection well laterally to a production well describes a linear path and such injection methods have a low efficiency when a large part of the host-rock is by-passed.

Methods to increase the efficiency of in-situ methods by drilling wells horizontally or in a direction parallel to a hydrocarbon-bearing formation such as tar-sand or coal, are suggested by U.S. Pat. Nos. 4,410,216, 4,116,275, 4,598,770, 4,610,303, and 5,626,191. Such orientation provides a line source for fluid or heat energy which can penetrate into the surface(s) around the borehole. The shortcoming of the methods is the limited penetration into the hydrocarbon-bearing formation, so that a plurality of holes have to be drilled. Also there is no systematic control of the fluid or heat-flow, its rate, its penetration, etc., or of the condition of in-situ physical conditions, such as temperature, and rate of chemical reaction.

U.S. Pat. No. 4,550,779 suggested that fluid can be induced to flow from one porous and permeable formation vertically into another porous and permeable formation. However, the method cannot be used unless at least a pair of such formations are present. Also the efficacy of the process is limited by the relatively low permeability of natural formations.

An "in-situ chemical-reactor for recovery of metals or purification of salts" is disclosed in our co-pending patent appln. Ser. No. 08/852,327 filed May 7, 1997.

It is an object of the present invention to improve the previously described in-situ reactor and to facilitate physical and chemical changes in coal (including lignites), oil-shale, tar-sand, and other carbonaceous deposits to produce hydrocarbons after the hydrocarbons in those deposits have been made less viscous, or to produce thermal energy in the form of hot combustion products, which can be recovered and converted into other forms of energy, such as electricity.

SUMMARY OF INVENTION

The present invention relates to hydrologic cells which permit fluid to be injected into a source-aquifer and from there to enter host-rock containing coal, lignite, oil, tar or other hydrocarbons recoverable under the hydrodynamic potential of the hydrologic cell. The fluid drives liquid hydrocarbon and/or reacts with coal, lignite, oil, tar in the host-rock, to produce recoverable hydrocarbons and/or hot combustion products. Those products can then be recovered by flowing them through a host-rock which is naturally or artificially rendered permeable to a sink-aquifer located on the side of the chosen body of host-rock opposite the side on which the source-aquifer is located.

The present invention recovers thermal energy in the form of hot gases or hydrocarbons from host-rock formations bearing coal, oil-shale, tar-sands or oil. The hydrologic cell used in the system has at least one source aquifer and one sink-aquifer and a body of host-rock located between the source-aquifer and the sink-aquifer. The source-aquifer and the sink-aquifer are each independently connected to the surface by a series of boreholes drilled in the host-rock. The boreholes connecting the source-aquifer with the surface are designed to convey reacting fluid, fuel and oxygen to the source-aquifer. The boreholes connecting the sink-aquifer to the surface are designed to move extracted thermal energy from the sink-aquifer to the surface. The hydrologic cell also has means for igniting the fuel and oxygen located in the source-aquifer in order to provide means for extracting the desired hydrocarbon or thermal energy from the host-rock. Extracting fluid, fuel and oxygen are moved under pressure from the surface into the source-aquifer, ignited and under pressure, forced to migrate through the host-rock to the sink-aquifer. The hot gases or hydrocarbons created by the action of the reacting fluid or burning resulting from ignition of the fuel and oxygen is removed from the sink-aquifer through independent boreholes to the ground surface. Thereafter, the energy is utilized in various forms as required.

BRIEF DESCRIPTION OF THE DRAWINGS

This invention proposes a new and novel approach of supplying fuel, oxygen and/or chemical reagents to react with the host-rock in-situ to produce hydrocarbons.

The drawings show the arrangement of hydrologic cells with horizontal aquifers, which are the most common type. However, aquifers could also be arranged in orientations other than horizontal.

Figure 1:
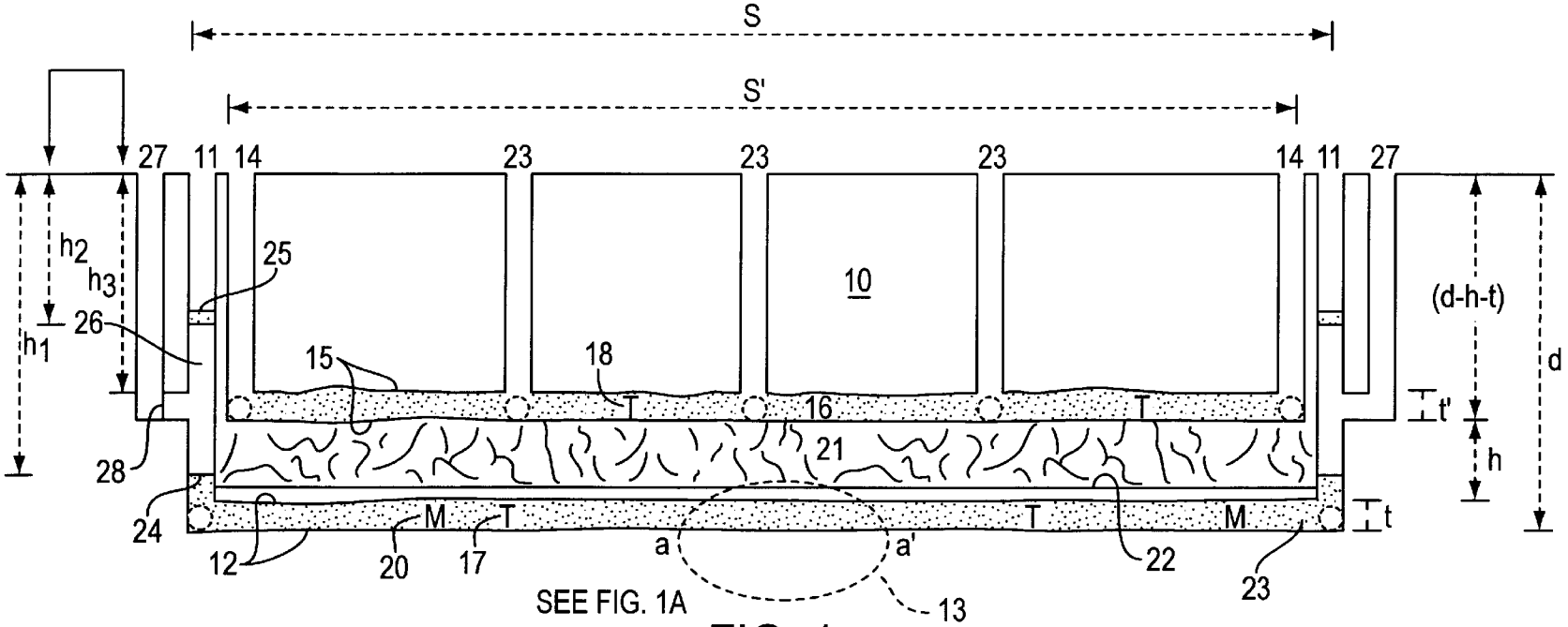
FIG. 1 is a longitudinal cross-sectional view of an in-situ reactor for the processing of relatively impermeable host-rock.
Figure 1A:
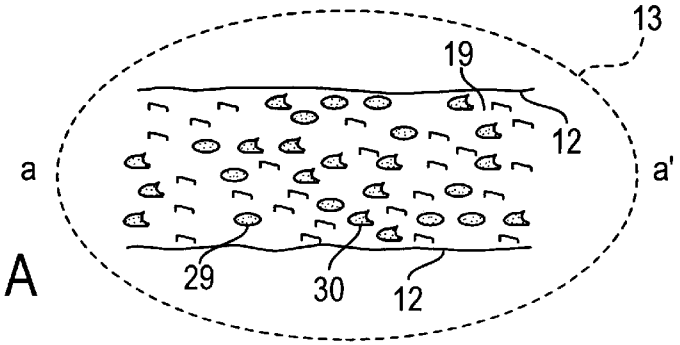
FIG. 1A is an exploded view of a portion of 13 of FIG. 1 taken on section a–a' of FIG. 1.

As used in the foregoing Figures, reference letters shown have the following meaning:

d=the mean depth of source-aquifer h=the separation between the source- and sink-aquifers d-h=the mean depth of the sink-aquifer $h_1$=depth to which the wells are filled with sand s=length of the source-aquifer s'=length of the sink-aquifer t=thickness of the source-aquifer t'=thickness of the sink-aquifer w=width of the source-aquifer w'=width of the sink-aquifer, approximately the same as w

DETAILED DESCRIPTION OF THE INVENTION

In the present invention, fluid and/or heat are induced to flow from one natural or artificial aquifer, commonly horizontal, across the host-rock to a parallel aquifer, whereas current methods of secondary recovery of hydrocarbons, by fracturing and/or by heating the host-rock, cause the fluid or heat to flow in a radial direction in the host-rock from one well to another well. The advantage of having aquifers is twofold: (1) the volume rate of the movement can be much greater because of the larger cross-section perpendicular to the direction of flow, and (2) the physical condition and the chemical process within the in-situ reactors can be controlled by varying the rate of injection of fluid into, and removal of fluid from the artificial aquifers.

The aquifers are the polarities of a hydrologic cell, like the electrodes of a battery or electric cell. The aquifers are commonly horizontal but they can be made to be inclined at any angle from the horizontal. The novelty of the invention is the use of such hydrologic cells to facilitate the injection of fluid into, and removal of fluid from, the host-rock. Although the use of one or two hydrologic cells is generally referred to herein, in some instances, a combination of additional hydrologic cells in parallel or in series may be desirable.

Production of hydrocarbons in rock beds can be enhanced by secondary recovery methods such as water-flooding or steam injection wherein water or steam moves from a well into a permeable source-aquifer in a radial direction parallel to the hydrocarbon bed. The fluid or steam then moves from an artificial source-aquifer to an artificial sink-aquifer, commonly in a direction perpendicular to the bedding plane of the hydrocarbon bed. To achieve this result, fracture surfaces above and below and parallel or inclined to the hydrocarbon bed surfaces are produced by present hydrofracture methods. Artificial aquifers can be produced by injecting sand or other proppants into the fracture surfaces. A porous and permeable aquifer, commonly underlying the hydrocarbon bed and receiving injected fluid forms the source-aquifer. A porous, permeable aquifer, commonly overlying the hydrocarbon bed, receiving hydrocarbon released from the host-rock (displaced, e.g., by the injected water or steam) is the sink-aquifer. The two aquifers thus constitute two opposite ends of a hydrologic cell. Water or steam injected into the source-aquifer will flow across the hydrocarbon-bearing bed, and drive the hydrocarbon into a sink-aquifer, from where it will flow or be pumped out of boreholes drilled into the sink-aquifer.

In some places, it may be more economical to produce the thermal energy by in-situ burning, instead of recovering the carbon or hydrocarbon-bearing material from underground by mining or petroleum recovery techniques, (e.g., U.S. Pat. No. 5,626,191). As current methods are not sufficiently efficient to be widely applicable, thermal energy can be produced, by in-situ burning which is made possible through the injection of fuel or other combustible material into an artificial underground aquifer to initiate burning and injection of oxygen into such aquifer to sustain burning. To achieve this result, fracture surfaces above and below a host-rock can be produced by hydrofracturing methods currently used. Sand or other proppants are then injected into the fractures. Liquid and/or gas containing oxygen injected into the source-aquifer will flow into, and react with the carbon or hydrocarbon in the host-rock. The thermal energy is recovered when the combustion products, in the form of hot gases, flow into the sink-aquifer, from which they flow or are pumped out of boreholes for further processing.

Hydrocarbons and hot gases can be recovered from coal, oil-shale, tar-sand, etc. by in-situ distillation, carbonization, hydrogenation or other processes, which have been developed for factory processing of those rocks. Since those processes can only take place at a temperature higher than ambient temperature, the temperature of the in-situ chemical-reactor for distillation, carbonization, hydrogenation, etc. has to be raised to an elevated temperature. For in-situ chemical reactions at an elevated temperature in a in-situ chemical-reactor, the underground temperature must be raised by an underground heat source. The burning of a part of the host-rock could be such a heat source.

Especially in cases where in-situ chemical reactions require the introduction of reagents into the source-aquifer of the in-situ reactor, the heat source would require another in-situ reactor located at some distance, commonly beneath the in-situ chemical-reactor. The burning of the carbonaceous material of the former provides the heat to elevate the temperature of latter so that chemical reactions between the carbon in the host-rock and injected fluid can take place in the latter to effect the carbonization, distillation, or hydrogenation to produce hydrocarbons from the host-rock of the latter.

For recovery of hydrocarbons from coal, oil-shale, tar-sand, etc. in in-situ chemical reactions, two in-situ reactors may thus be employed. One reactor is designed as a chemical-reactor. Fluids or chemical reagents introduced into the source-aquifer move through the hydrologic cell to react with host-rock containing coal, oil-shale, or tar-sand, and then flow to the sink-aquifer. Through the elevated temperature and/or chemical reactions between the injected fluid and the host-rock, the carbonaceous matter in the host-rock can be carbonized, distilled or hydrogenated.

The other reactor in a two-reactor system is designed as a heat reactor using in-situ burning of carbonaceous material in the host-rock located between a source-aquifer for the injection of oxygen (with or without additional fuel) and a sink-aquifer. The temperature in the reactor can be raised high enough for the carbonization, distillation, or hydrogenation process in the overlying chemical-reactor to take place.

The rate of chemical reaction between the injected fluid and the host-rock in the overlaying chemical-reactor is adjusted by injecting fluid of a given composition needed for processing rock bodies into the source-aquifer of the chemical-reactor. The temperature of the chemical-reactor can be regulated by the rate of reaction in the heat reactor. This can be achieved by injecting at a suitable rate a fluid with a suitable oxygen content into the source-aquifer of the heat-reactor. Reacted fluid flowing into the sink-aquifer of the chemical-reactor is transferred via boreholes to the surface. Hydrocarbons distilled out of oil-shales or hydrogenerated from tars in tar-sands can be transferred to refineries for further processing. Hot gases produced from burning of coal or other carbonaceous-bearing rocks yield thermal energy to produce steam to drive turbines and produce electricity.

Residual carbon (coke), tar, or other carbonaceous matter which still remain in either or both of the in-situ reactors after distillation, carbonization or hydrogenation can be induced to chemically react again with fluid injected into source reservoirs, or their thermal energy can be exploited in the form of hot gases produced by in-situ burning.

In carrying out the present invention in-situ reactor 10 as shown in FIG. 1 is provided with artificial source-aquifer and artificial sink-aquifer 16 with host-rock 21 lying between source-aquifer 13 and sink-aquifer 16. The artificial aquifers can be made by pumping hydrofracturing fluid into a series of parallel, horizontally drilled wells 11 and 14 to produce horizontal fractures 12 and 15 which are propped open by sand or other proppants 30 injected into the fractures. Mixed with the proppants in the source-aquifer can be liquid fuel 19 and/or solid fuel 29. A triggering mechanism 20 to ignite the fuel is installed in the source-aquifer 13, and instruments to monitor temperature 17, 18 are also installed in the source and sink-aquifers 13, 16. The reacted fluid flowing into the sink-aquifer 16 is transferred via boreholes to the surface. Fluid can be injected into the source-aquifer by moving the piston 25 above the compression chamber 26, or compressed fluid can be introduced through auxilary boreholes 27 and valves 28, or through a valve in the piston 25.

Figure 2:
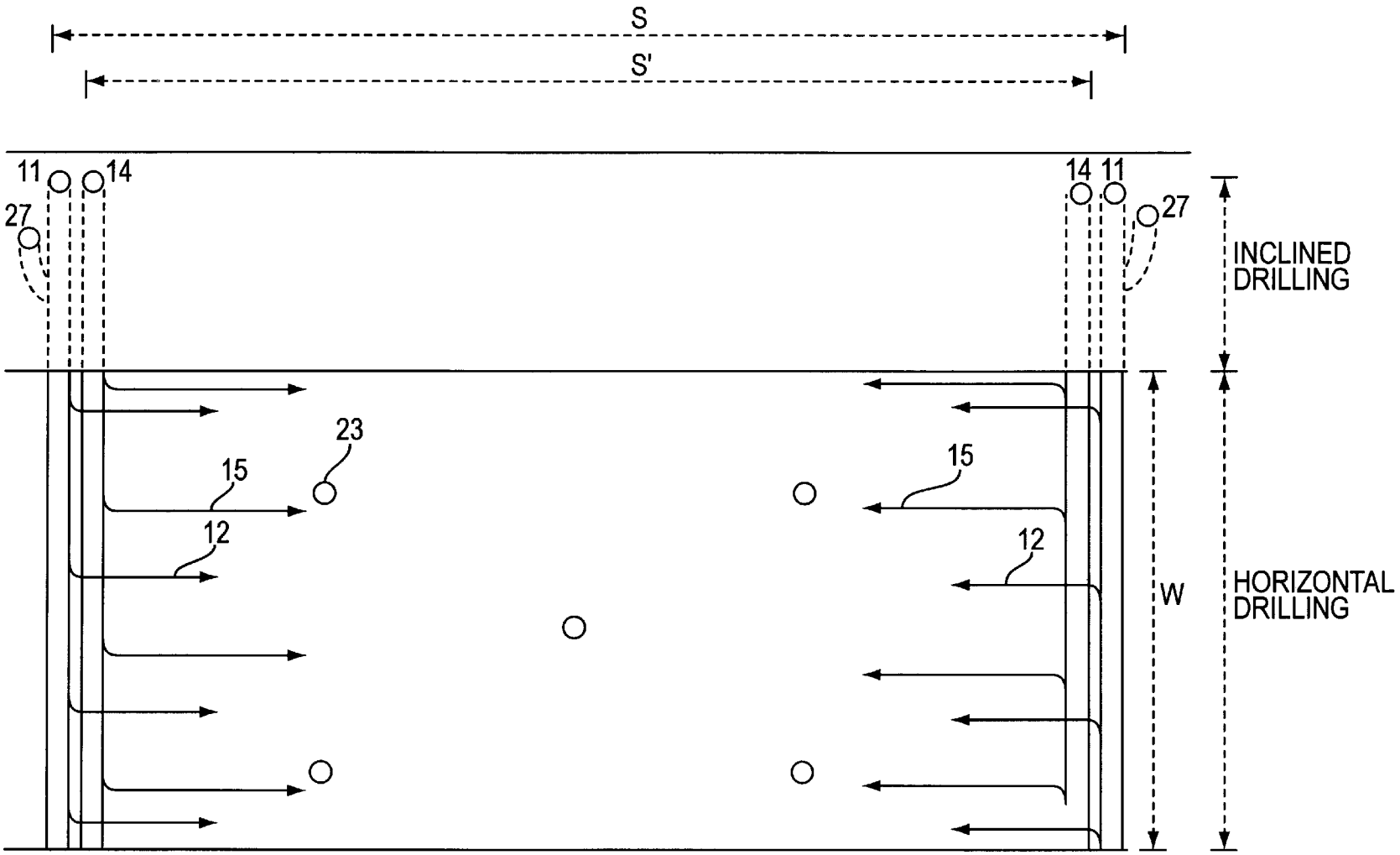
FIG. 2 is a plan view of the in-situ reactor of FIG. 1.

As shown in FIG. 2, which is a section parallel to the sink-aquifer of the in-situ reactor showing the lengths s, s' and widths w, w' of the in-situ reactor and the position of boreholes 23, wells 11, 14 are bored by a horizontal-drilling technique. The wells 27 are drilled nearly vertically into wells 11 to feed compressed fluid into the source-aquifer.

Figure 3:
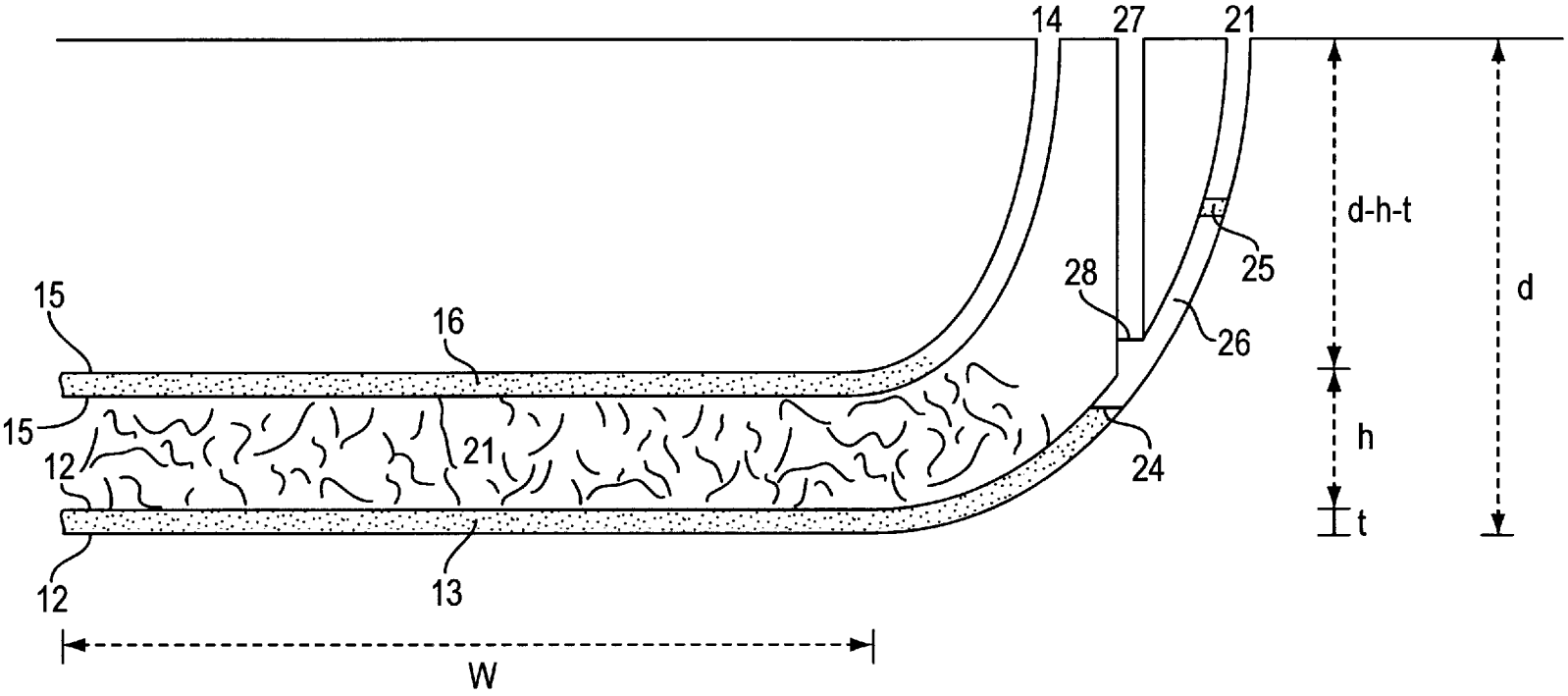
FIG. 3 is a transverse cross-sectional view of the in-situ reactor of FIG. 1.

As shown in FIG. 3, the horizontal fractures 12 and 15 formed by the horizontal drilling of wells 11 and 14, and the nearly vertical drilling of wells 27, are propped open by proppants to form source-aquifer 13 and sink-aquifer 16, respectively.

Figure 4:
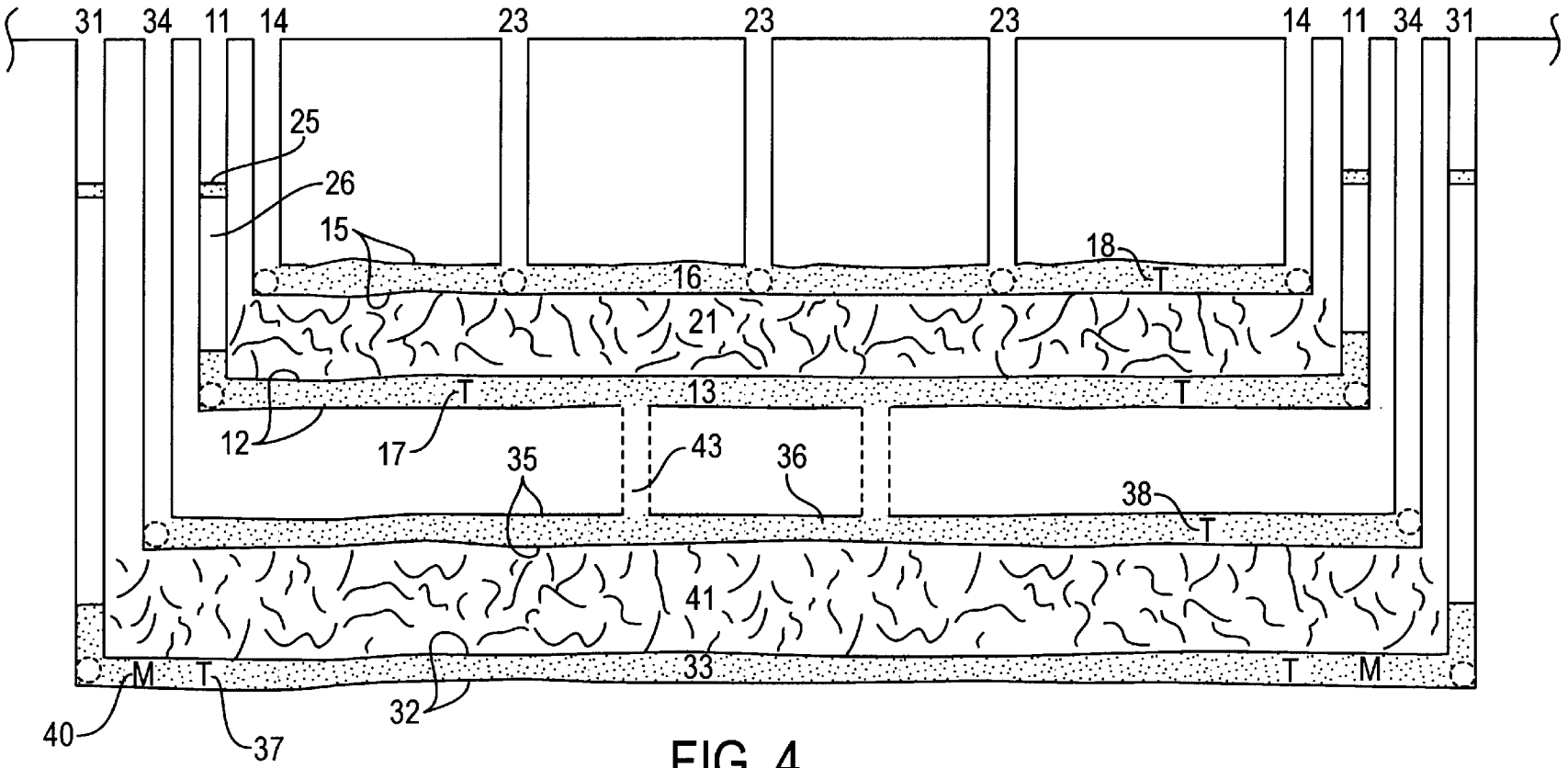
FIG. 4 is a longitudinal cross-sectional view of a dual in-situ reactor with a "coding" and a "reacting" section.

The "reacting" section in a dual in-situ reactor such as shown in FIG. 4, where at least two pairs of source-aquifers and sink-aquifers are present, has its source and sink-aquifers 13, 16, and the "heating" section has its source and sink-aquifers 33, 36. The artificial aquifers are made by pumping hydrofracturing fluid into horizontally drilled wells 11 and 14 to produce horizontal fractures 12 and 15, which are propped open by sand or other proppants. A triggering mechanism 40 to ignite the fuel is installed in the source-aquifer 33, and instruments to monitor temperature 17, 18 and 37, 38 are also installed in the source and sink-aquifers 13, 16 and 33, 36. The reacted fluid flowing into the sink-aquifer 16 of the reacting section is transferred via boreholes 23 to the surface. The dashed circles in the figure indicate the location of the horizontally drilled wells. Additional boreholes 43 can be drilled to channel hot gas from sink-aquifer 36 to source-aquifer 13 located in the overlying reactor.

The in-situ reactors of the present invention can effect three kinds of processes: (1) secondary recovery of hydrocarbons in the beds by means of a mechanical displacement of the hydrocarbons in the beds, when a fluid injected into a source-aquifer flows through the bed into a sink-aquifer, (2) recovery of hydrocarbons or of thermal energy from a carbonaceous rock after an elevation of temperature (which reduces the viscosity of hydrocarbon) or after the burning of the carbon or hydrocarbon in host-rock (carbonization, distillation) when fluid injected into a source-aquifer flows though the host-rock into a sink-aquifer, (3) recovery of hydrocarbons from coal, oil-shale, or tar-sand after a chemical reaction at elevated temperature between a fluid injected into a source-aquifer flowing through host-rock (hydrogenation) to cause a hydrocarbon or hydrocarbon fraction to flow into a sink-aquifer. These three cases are described as follows:

(1a) Secondary Recovery of Hydrocarbons from relatively Impermeable Oil Reservoirs Hydrocarbons in hydrocarbon-bearing beds are produced by secondary recovery through water-flooding or steam injection whereby the water or steam moves in a radial direction parallel to the hydrocarbon bed. In the present invention, secondary recovery occurs when the fluid moves in a direction perpendicular to the bed.

For secondary recovery of oil from reservoirs at shallow depth, either two parallel natural aquifers are utilized or two artificial aquifers are constructed, commonly one above and one below the hydrocarbon-bearing bed (FIGS. 1,2, and 3). Constructing artificial aquifers utilizes the principle that a tension crack or a fractured surface in underground rock will form in the direction of the greatest compression, one can cause the origination of a horizontal compressive stress at shallow depths underground by increasing the hydrostatic pressure of the fluid injected into two parallel wells 11; produced by "horizontal drilling", spaced s meters apart, to depth d, with a horizontal length w. A tension crack 12, with a top plan area of s×w is formed by artificially induced tension. The fracture surface at depths less than 1,000 m should be horizontally oriented. Sand or other proppants are injected into the fracture to convert it into the source-aquifer 13 having a thickness t as shown in FIG. 1.

Fluid is then injected into another pair of parallel wells produced by "horizontal drilling" 14, spaced W meters apart, but drilled to a shallower depth (d-h), to form another horizontal tensional crack 15. Sand or other proppants are injected into the fracture 15, between the two parallel wells, to convert the fracture into a sink-aquifer 16 as shown in FIG. 1.

The oil-bearing host-rock 21 between the two aquifers can be further fractured, if there is need to increase its porosity and permeability. Inert fluid can be pumped into both aquifers to cause hydrofracturing; tensional cracks in the host-rock 21 produced by this vertically directed compressive stress tend to be vertically or nearly vertically oriented, so as to facilitate the upward movement of fluid from the source-aquifer 13 to the sink-aquifer 16.

To start the secondary recovery, water or steam is injected into the source-aquifer 13, while fluid is pumped out of the sink-aquifer 16, establishing a vertically oriented hydrologic gradient between the two aquifers Fluid is forced to flow from the source-aquifer into a reservoir, and drive the hydrocarbon in host-rock 21 into the sink-aquifer, from where it will flow into, or is pumped out of, boreholes 23 drilled into the sink-aquifer 16.

(1b) Secondary Recovery of Hydrocarbons from relatively Permeable Oil Reservoirs.

Where the oil reservoir is relatively permeable, secondary and/or tertiary recovery of hydrocarbons can be effected through flows parallel to the bedding planes of the reservoirs. Source and sink aquifers can be constructed as injection beds and production beds at an angle to the horizontal, and costs can be saved by drilling vertical or inclined, instead of horizontal wells.

Where inclined or vertical wells are present in producing fields, the source and sink aquifers can be constructed between two pairs of wells which are selected as the injection-pair and the production pair respectively. The wells are cemented and made impermeable except for a slit in each well across the thickness of the producing oil-reservoir in the direction facing the other well of the pair. Compressed fluid is pumped into the pair of injection wells to effect the formation of a vertical (or slightly inclined) hydrofracture in the direction of the slit of each well. The hydro-fractured surface can be excavated and propped open by the introduction of proppants into each well, until the hydrofractured surfaces from the two injection wells meet to constitute the source aquifer. The same technique is used to form the sink-aquifer between a pair of producing wells. At the start of the projection, fluid is pumped into the injection wells and pumped out of producing wells, so that a hydrodynamic gradient is produced to drive the hydrocarbons in the reservoirs from the source to the sink reservoir. Thermal stimulators can be installed in the source and sink aquifers to increase the efficiency of recovery after the viscosity of the hydrocarbon in the reservoir is decreased by an elevated temperature. The efficiency of recovery using the pair of aquifers can be expected to increase from the present 25–40% to 60–95%.

(2) Recovery of Thermal Energy from Carbonaceous Rocks by In-situ Burning

Currently coal is mined by excavation, brought to the surface, and shipped to power plants in the cities to generate electricity, and oil is produced by drilling, flowing out of boreholes or pumped up to the surface, and piped to plants in cities to generate electricity. Due to the cost of recovery and transportation, only the more enriched resources can be economically recovered: thin coal seams and hydrocarbons in depleted oil fields must remain underground. Furthermore, the production of the more enriched resources by current methods is never 100% efficient. Much of the hydrocarbon in oil reservoirs remains underground after primary and secondary recoveries. Consequently, oil fields are abandoned when the oil remaining underground can no longer be profitably extracted, even when the oil remaining may consist of much more than half of the total reserve.

Current methods to recover the energy from oil-shale have been categorized as shale-burning. The common method is to excavate a substantial quantity of oil-shale (e.g. U.S. Pat. No. 3,661,423), causing collapse of the oil-shale roof, a process which makes the fallen roof into a porous and permeable debris pile. Fluid containing oxygen is pumped into the oil-shale debris and ignited to burn off some of the hydrocarbons in the oil-shale, while the heat of shale-burning causes a decrease in the viscosity of other hydrocarbons in the oil-shale so that they could flow out of the rock and are recovered. The methods have been used experimentally by major petroleum companies, but large scale recovery has been found to be non-economical at present and current production of oil from oil-shales is insignificant.

Current methods to produce hydrocarbons from carbon or hydrocarbon-bearing rocks such as lignite, coal, and tar-sands have been called carbonization, distillation, and hydrogenation processes. Numerous patents disclose methods to extract hydrocarbons from coal, oil-shale, and tar-sands and major petroleum companies are investing large sums to develop new techniques to exploit the great reserves of tar-sands for hydrocarbon production. Almost all of these require factory processing, which is both uneconomical and detrimental to environment.

A large fraction of the fossil fuels produced today is burnt in city power plants to generate electricity. To satisfy such energy demand, the materials yielding thermal energy need not be produced by bringing them up to the surface, and transported to generating plants. Coals, oil-shales and tar-sands could be recovered by the in-situ burning processes, when the combustion products in the form of hot gases could be fed to an electric generating plant. Current shale-burning processes have to be modified to achieve this goal, because of the difficulty of supplying oxygen to effect the burning.

Previous methods of shale-burning attempted to force the oxygen-bearing fluid directly into the target volume of the host-rock. The presently described in-situ reactor with hydrologic cells is designed to introduce fuel and oxygen (with or without additional fuel) indirectly into a target volume of host-rock through its direct injection into a porous and permeable artificial reservoir, i.e. a source-aquifer. The continuous supply of the injected fluid adjacent to the host-rock sustains the in-situ oxidation or burning of the host-rock.

The temperatures and pressures of burning can be monitored, and the shale-burning can proceed under controlled condition, when the rate of burning and consequently the in-situ temperature can be adjusted through a variation of the rate of oxygen supply into the source-aquifer. The products of combustion, in the form of hot gases can flow, through natural or artificially induced fractures into the sink-aquifer, from which the products can be drained or pumped out via exhaust boreholes and then piped into a generating plant.

For burning carbon or hydrocarbon-bearing rocks, two parallel artificial aquifers are constructed, one above and one below the host-rock to be burnt (FIGS. 1, 2 and 3). Utilizing the principle that a tension crack or a fractured surface in an underground rock will form in the direction of the greatest compression, one can cause the origination of a horizontal compressive stress at shallow depths underground by increasing the hydrostatic pressure of the fluid injected into two parallel wells 11 produced by "horizontal drilling", spaced s meters apart, to depth d, with a horizontal length w. Horizontal fractures 12, between the two parallel wells 11, 11; with a top plan view area of s×w is formed by artificially induced tension, and the fracture surface 12 at depths less than 1,000 m is commonly horizontally oriented. Sand or other proppants are injected into the fracture to convert it into artificial source-aquifer 13, which has a thickness t. Fluid is then injected into another pair of parallel wells 14 produced by "horizontal drilling", spaced s' meters apart but drilled to a shallower depth (d-h), to form another horizontal tension crack 15. Sand or other proppants are injected into the horizontal fracture 15, between the two parallel wells 14, to convert it into the sink-aquifer 16.

Injection wells 11 are filled with sand or packed with gravel. Separated from the atmosphere air by the sand, the combustion in the source-aquifer will not ignite the air and cause uncontrollable fires. Injection wells 14 may or may not be filled with sand, depending upon the nature and temperature of the fluids flowing out of the sink-aquifer 16. Temperature-measuring devices 17, 18 are installed in the aquifers. Fuel 19 can be mixed with the injected material, and a mechanism 20 to trigger burning is installed in the source-aquifer 13.

The host-rock to be burned between the two aquifers can be further fractured, if necessary to increase its porosity and permeability. Inert fluid can be pumped into both aquifers to cause the hydrofracturing of the host-rock. The tensional cracks in the host-rock 21 produced by this vertically directed compressive stress tend to be vertically or nearly vertically oriented, so as to facilitate the upward movement of fluid from the source-aquifer 13 to the sink-aquifer 16 during the combustion of the host-rock. Fluids are, however, to be withdrawn from both aquifers, so that they will be subjected to normal hydrostatic pressure at the start of the underground burning.

To start the burning process, oxygen-bearing fluid is injected under pressure from the surface to the source-aquifer 13, where the fluid is ignited by the trigger mechanism 20 to react with the carbon or hydrocarbon-bearing host-rock 21 directly above the source-aquifer 13. Since pressure of the upper (sink) aquifer is hydrostatic, or less when fluid is being pumped out of the sink-aquifer 16, a hydraulic potential gradient is established between source-aquifer 13 and sink-aquifer 16. The product of combustion in the form of hot gases will either seep through the host-rock 21 with an upward advancing burning front 22, and/or flow through the fractures if the host-rock 21 has been previously fractured. The rate of fluid flow through the host-rock depends upon its permeability, and can be adjusted by varying the pumping pressure injecting oxygen into the source-aquifer 13. The temperature of combustion can also be adjusted by varying the rate oxygen is supplied to the source-aquifer 13.

The end product of the combustion can be a mixture of steam and carbon dioxide, steam, or coal gas, depending upon the temperature pre-determined by the operator. The combustion products flowing into the sink-aquifer 6 are then transferred via boreholes 23 to surface. Their thermal energy can be utilized for heating by end users, or converted into other forms of energy such as mechanical or electric energy.

(3) Recovery of Hydrocarbons from Coal, Oil-Shale, or Tar-Sands by In-situ Chemical Processes Hydrocarbons are needed as raw materials by the petrochemical and other industries. Carbon and hydrocarbons in rocks are thus preferably recovered as hydrocarbon products (rather than as thermal energy) where such recovery through in-situ carbonization, distillation or hydrogenation is economically feasible.

To effect such in-situ chemical processes at elevated temperatures, the in-situ reactor also acts as a "heater" to raise the temperature underground so that chemical reactions can take place in an overlaying reactor at a desired temperature.

In some cases, especially where chemical reagents have to be introduced into the reactor to effect a chemical reaction, there is a need for two in-situ reactors: a "heater" with a source-aquifer 13 into which fuel and/or oxygen is injected to raise the underground temperature, and a "reactor" with a source-aquifer 13 into which chemical reagents are injected to effect chemical reaction between the host-rock 21 and the injected fluid (FIG. 4).

A system of two in-situ reactors can be constructed, commonly one on top of another, and each is constructed the same way as previously described. Fluids injected into wells 11 and 14 produce, by hydrofracturing, two horizontal fracture surfaces 12, 15, above and below a host-rock 21 respectively (FIG. 1). Injecting sand or other proppants into the fractures, converts the fractures into the source-aquifers 13 and the sink-aquifer 16. Temperatures measuring devices 17 and 18 are then installed to monitor the temperature gradient of the host-rock to be processed chemically.

The host-rock to be processed chemically between the two aquifers can be further fractured, if there is need to increase its porosity and permeability. Inert fluid can be pumped into both aquifers to cause the hydrofracturing of the host-rock, and to facilitate the movement of fluid from the source-aquifer 13 to the sink-aquifer 16 during the combustion of the host-rock. After the hydrofracturing of the host-rock, fluids are partially withdrawn from both aquifers, so that they are again subjected to normal hydrostatic pressures at the start of the underground carbonization, distillation or hydrogenation.

In summary, to raise the temperature of the in-situ reactor for carbonization, distillation or hydrogenation, a source of heat is required. The host-rock in the lower part of an in-situ reactor can be burnt to be the heat source. Alternatively, where it is necessary, a system of two reactors can be used: a "heater" and a "reactor". The lower in-situ reactor performs the function of a "heater" to promote reaction in the "reactor" of the host-rock in the in-situ chemical-reactor above.

The in-situ "heater" can be constructed as previously described for the purpose that the thermal energy is to be expended to elevate the temperature of the overlying in-situ chemical-reactor. Fluid injected into two horizontally drilled wells 31, 34 produces, by hydrofracturing, two horizontal fracture surfaces 32, 35, above and below a host-rock 41 to be burnt. Sand or other proppants are injected into the fractures, which constitute source-aquifer 13 and sink-aquifer 16. Temperature measuring devices 37, 38 are installed in the aquifers to monitor the temperature gradient of the host-rock to be processed chemically. Trigger mechanism 40 is used to trigger combustion in the source-aquifer 33.

Depending upon the temperature desired, solid fuel such as coal 29 or liquid fuel 19 could be injected with sand or other proppants 30 into the lower source-aquifer 33 and ignited to trigger the burning of carbonaceous material in the host-rock between the aquifers 33 and 36. Oxygen-bearing fluid is continually injected into the source-aquifer 33 of the in-situ heater to sustain the burning and thus to raise the temperature underground. The combustion products can be channeled to the surface via the upper sink-aquifer 36 and borehole holes 43. The temperature of the upper in-situ chemical-reactor can thus be raised by the burning of the carbonaceous materials in the "heater" to a desired temperature.

In cases where the hydrocarbon in the host-rock of the overlying in-situ chemical-reactor is only to be heated for distillation, the sink-aquifer 36 of the in-situ "heater" could serve as the source-aquifer 13 of the overlying chemical-reactor, being situated immediately under the host-rock to be heated. In cases where the carbon or hydrocarbon in the host-rock 21 of the overlying in-situ chemical-reactor is to be treated chemically, chemical reagents are to be injected into its source-aquifer 13. The sink-aquifer 36 of the in-situ "heater" should be placed at a lower depth than the source-aquifer 13 of the overlying in-situ chemical-reactor.

The temperature of the "heater" and of the overlying reactor can be controlled, mainly by varying the rate of oxygen supply to the source-aquifer 33 of the "heater", and by varying the rate of the movement of fluids through the host-rock 21 of the in-situ chemical-reactor between aquifers 13 and 16.

DESCRIPTION OF THE PREFERRED EMBODIMENT (1) Secondary Recovery of Hydrocarbons from relatively Impermeable Oil Reservoirs.

In one embodiment of the present invention loose material such as quartz sand or other proppants, is injected under pressure in a hydrologic cell such as shown in FIG. 1, through horizontally drilled boreholes 11 and 14 and to the horizontal fractures 12 and 15 produced by hydrofracturing, so as to make a porous and permeable artificial reservoir. The body of injected loose material in fracture 12 forms a layer and serves as the source-aquifer 13.

The oil-bearing bed 21 between the two aquifers 13 and 16 can be further fractured, if there is need to increase the porosity and permeability of the host-rock. Inert fluid can be pumped into both aquifers to cause the hydrofracturing. Tension cracks in rock 21 produced by this are vertically oriented, so as to facilitate the upward movement fluid from the source-aquifer 13 to sink-aquifer 16.

To start the secondary recovery, water or steam is injected into the source-aquifer 13, while fluid is pumped out of the sink-aquifer 16, establishing a hydrologic gradient, which is commonly vertically oriented, between the two aquifers. Fluid is forced to flow from the source-aquifer 13 to the host-rock 21, which is an oil-bearing bed, and drive the hydrocarbon in the oil-bearing bed 21 into the sink-aquifer 16, from where it will flow into, or is pumped out of, boreholes 23 drilled into the sink-aquifer 16.

(2) Recovery of Thermal Energy from In-situ Combustion of Carbonaceous Matter in Subterranean Carbonaceous Deposits.

In another embodiment of the present invention, loose material such as quartz sand or other proppants, is injected under pressure in a hydrologic cell such as shown in FIG. 1, through the horizontally drilled boreholes 11 and 14, and to the horizontal fractures 12 and 15 produced by hydrofracturing, so as to make a porous, permeable artificial reservoir. The body of injected loose material in fracture 12 forms a layer and serves as the source-aquifer 13 at the base of the chosen host-rock to be burned. To aid in-situ oxidation at high temperature, the injected loose material may be a mixture of sand, coal, and/or liquid fuel.

The lower injection wells 11 are drilled to depth d meters, to the base of the source-aquifer 13. Temperature measuring device 17 and mechanism 20 to trigger burning in the source-aquifer 13 are installed. The injection wells 11 are filled, up to depth above hi with clean sand or packed gravel 24. The permeable sand or gravel, which should be loosely cemented or tightly packed in the wells 11, serves as (a) a conduit for an injected fluid, such as compressed air, or a chemical solution, to be pumped into the source-aquifer, and (b) as an insulator so that underground burning will not cause the air in the boreholes to catch fire, causing the shale to burn out of control. The process of drilling and hydrofracturing is repeated to produce the upper sink-aquifer 16. The sand in the wells 14 may not need to be cemented, and additional boreholes 23 are needed to collect combustion products.

To facilitate the movement of the fluids through the host-rock between the two aquifers 13 and 16 as shown in FIG. 1, host-rock 21 can be further fractured to produce fracture porosity and permeability. The walls of wells 1 above $h_1$ meters are cemented. A piston 25 is installed in the well and can move between $h_2$ and $h_3$, thus forming a compression chamber 26. The downward movement of the piston compresses the air or other injected fluid in the compression chamber. The compressed air or fluid flows under pressure through the sand filled portion of well 24 into source-aquifer 13. When the pressure of chamber 26 is relieved during upward movement of the piston, air or fluid to be injected from outside enters a fluid supply borehole 27. When piston compression does not provide sufficient flow volume, compressed fluid can be supplied to the compression-chamber 26, from the surface through borehole 27 and valve 28 to be compressed and supplied to the source-aquifer 13, or alternatively from the surface through an valve in piston 25 into compression chamber 26.

To start of the burning of oil-shale, coal, lignite, or tar-sand, trigger mechanism 20 in FIG. 1 causes the combustion of fuel 19 in the source-aquifer 13, causing coal 29 which has been mixed with proppant 30 in aquifer 13 to burn. The temperature of the in-situ reactor can be adjusted by controlling the rate of oxygen-input and the rate of release of the combustion products from in-situ burning.

This process is applicable to recover energy from the thin coal seams, oil-shales, tar-sands, or from residual oil in depleted oil fields.

(3) Recovery of Hot gases through Carbonization of coal or Tar heated by In-situ combustion of Underground Carbonaceous Matter When coal or tar is heated in the absence of air to a temperature above 450° C., the coal or tar begins to decompose and an evolution of gaseous products occurs. As the carbonization progresses, the temperature of the decomposing coal or tar rises.

Coal or coal tar retorted at temperatures of 700° C. to 800° C., produces gas which is heavily charged with steam, derived from the hydrogen and oxygen in the coal as well as from actual moisture, together with condensable tarry vapors, hydrocarbons, etc. When the decomposing coal is heated to a still higher temperature of 900° C. to 1200° C., carbon decomposes steam into hydrogen and carbon monoxide which absorb heat and cause temperatures to fall. Carbon monoxide then reacts to form carbon dioxide and hydrogen. This principle also forms the basis of the industrial process for manufacturing water gas for consumers by alternately blowing a bed of coke with steam and air.

Coal retorting is no longer economical since coal gas and water gas have been replaced by natural (methane) gas for consumers. The use of hydrologic cells to permit low and high temperature in-situ carbonization could result in the manufacture of coal gas and/or water gas on an economical basis for energy consumption. Further, the hydrogen produced by the carbonization of tar in tar-sands could be supplied to an overlaying chemical-reactor for the hydrogenation of overlaying tar-sands.

Pollution is commonly associated with the burning of fossil fuel. The production of hydrogen sulfide and other toxic gases from in-situ combustion can be treated in plants and precipitated as solid waste, so that the only exhaust gas will be carbon dioxide.

Recovery of hot gases through the carbonization of coal or tar heated by an in-situ combustion of underground carbonaceouss matter can be achieved by either one, or a system of two, in-situ reactors constructed as previously described. Where combustion products from the "heater" do not interfere with the carbonization of the "host-rock" in the "reactor", the sink-aquifer 36 of the "heater" could be also the source-aquifer 13 of the "reactor".

(4) Recovery of Hydrocarbons through Distillation or Hydrogenation of Oil-Shale, Tar-Sand, etc., heated by an In-situ Combustion of Underground Carbonaceous Matter in an In-situ "heater"

The major categories of processes for recovery of hydrocarbons through distillation of oil-shale, tar-sand, etc. include pyrolysis (and hydropyrolysis), solvent extraction, and hydrogenation.

In retorting oil-shale, crushed shale is fed into retorts that crack the organic material (kerogen) with gas or steam at 350° C.–500° C. to produce crude oil similar in character to petroleum. Recent methods such as described in U.S. Pat. No. 4,587,006 and 5,041,210 using new integrated hydropyrolysis/thermal pyrolysis techniques can produce high yields of improved quality liquid hydrocarbon products and have reduced the heat and energy requirements. Kerogens can also be extracted by solvents from oil-shales or from tar-sands at relatively low temperatures as described in U.S. Pat. No. 4,130,474. Coal hydrogenation at about 200 atm and 450° C. with the addition of catalysts was done in Germany on a large scale before the end of the World War II, and the methods have been improved in recent years as described in U.S. Pat. No. 5,015,366 and UK Pat. 2,110,712. Numerous elaborate methods have been invented to extract liquid hydrocarbons from oil-shales and tars through hydrogenation. At temperatures of 450° C.–520° C., and a pressure of about 50 bar, for example, hydrocarbons can be extracted through the action of carbon monoxide, hydrogen and steam, but such methods all involve factory processes. Raw material has to be excavated, crushed, and retorted or processed in autoclaves. Factory processing requires the use of considerable amounts of energy and elaborate equipment and is thus very expensive. The present invention permits the use of such methods in in-situ processing.

Methods for underground retorting of oil-shale have been developed as described in U.S. Pat. Nos. 3,001,776, 3,434,757 and 3,661,423. The major difficulty consists of injecting oxygen into a relatively non-porous and impermeable oil. Several general approaches have been proposed to produce fractures underground; (1) conventional fracturing techniques by explosion or by hydrofracturing, and (2) excavation of a cavity to induce room collapse. Some have been tested, but none seem to be economical at the present.

For the recovery of hydrocarbons through the distillation of pyrolysis, or through the hydrogenation of coal, oil-shale, or tar-sand, a system of one or of two in-situ reactors can be constructed.

Fuel and oxygen are injected into source-aquifer 33 of the "heater" to burn the coal, oil-shale, or tar-sand. Oxygen is supplied at a rate so that the temperature of the "heater" can heat up the host-rock in the "reactor" to the desired temperature. The source of the steam and hydrogen in source-aquifer 33 for retorting or for hydrogenation can either be supplied from the sink-aquifer 36 of the "heater", and/or from the surface and injected into the source-aquifer 13 of the "reactor".

While the present invention has been described by means of the foregoing embodiments, it is to be understood that the invention is not limited thereto, reference being had to the claims appended hereto for the scope of the invention.

What is claimed is:

1. An underground system for recovery of hydrocarbons and thermal energy in the form of hot gases from host-rock formations bearing coal, oil shale, tar-sands or oil which system comprises a hydrologic cell located within said formations, said hydrologic cell having at least one source-aquifer and one sink-aquifer, and host-rock located between said source-aquifer and said sink-aquifer, said source-aquifer and said sink-aquifer each being independently connected to the ground surface by a series of boreholes drilled in said host-rock, said boreholes connecting said source-aquifer with the surface being capable of conveying extracting fluid, fuel and oxygen to said source-aquifer, said boreholes connecting said sink-aquifer with the surface being capable of moving extracted thermal energy from said sink-aquifer to the surface, means for igniting said fuel and oxygen located in said source-aquifer, means for moving said extracting fluid, fuel and oxygen from said source-aquifer through said host-rock to said sink-aquifer and means for removing said extracted thermal energy from said sink-aquifer through said boreholes to said ground surface.

2. The underground system according to claim 1 wherein said source and sink-aquifers are formed by hydrofracturing.

3. The underground system according to claim 2 wherein said source and sink-aquifers are maintained by injection of proppants into said aquifer fractures.

4. The underground system according to claim 1 wherein said source and sink-aquifer are horizontal or inclined fractures of definitive dimensions.

5. The underground system according to claim 1 wherein said boreholes connecting said source-aquifer to said ground surface have piston and valve means located therein to assist in conveying extracting fluid, fuel and oxygen to said source-aquifer.

6. The underground system according to claim 1 wherein said hydrologic cell has a lower first source-aquifer, a lower first sink-aquifer, an upper second source-aquifer located above said first sink-aquifer and a second sink-aquifer located above said second source-aquifer.

7. A process for recovering thermal energy in the form of hot gases or hydrocarbons from host-rock formations bearing coal, oil-shale, tar-sands or oil which comprises injecting an extracting fluid containing fuel and oxygen under pressure through boreholes into a source-aquifer, igniting said fuel and oxygen in said source-aquifer causing said ignited extracting fluid to migrate under pressure through said host-rock to said sink-aquifer to release hot gases and hydrocarbons and removing said hot gases and hydrocarbons from said sink-aquifer through boreholes to said ground surface.

5,868,202
15 16

* * * * *